US007065901B2

(12) United States Patent
de Vroome

(10) Patent No.: US 7,065,901 B2
(45) Date of Patent: Jun. 27, 2006

(54) METHOD AND DEVICE FOR COOLING A MATERIAL WEB

(75) Inventor: Clemens Johannes Maria de Vroome, BB Beugen (NL)

(73) Assignee: Goss International IWC, Bolingbrook ( * ) Notice: Subject to any disclaimer, the term of this patent is extended or adjusted under 35 U.S.C. 154(b) by 570 days.

(21) Appl. No.: 09/999,660

(22) Filed: Oct. 24, 2001

(65) Prior Publication Data

US 2003/0221332 A1 Dec. 4, 2003

(30) Foreign Application Priority Data

Oct. 24, 2000 (DE) ..... 100 52 831

(51) Int. Cl.
*F26B 7/00* (2006.01)

(52) U.S. Cl. ..... 34/392; 34/525; 101/487

(58) Field of Classification Search ..... 34/116, 34/117, 391, 392, 393, 329, 556; 101/488, 101/228, 487

See application file for complete search history.

(56) References Cited

U.S. PATENT DOCUMENTS

| | | | | |
|---|---|---|---|---|
| 1,291,626 | A * | 1/1919 | Parks | 34/392 |
| 1,675,274 | A * | 6/1928 | Miller | 34/392 |
| 2,796,678 | A * | 6/1957 | McKeown | 34/43 |
| 4,625,430 | A * | 12/1986 | Aula et al. | 34/13 |
| 4,637,341 | A * | 1/1987 | Switall | 118/694 |
| 4,846,060 | A * | 7/1989 | Proctor | 101/228 |
| 4,920,881 | A * | 5/1990 | Tafel | 101/488 |
| 5,056,430 | A * | 10/1991 | Bayerlein et al. | 101/211 |
| 5,188,028 | A * | 2/1993 | Reichel | 101/228 |
| 5,275,103 | A * | 1/1994 | Hahne | 101/488 |
| 5,471,847 | A | 12/1995 | Murray et al. | |
| 5,571,564 | A * | 11/1996 | Helms et al. | 427/288 |
| 5,642,671 | A * | 7/1997 | Winheim | 101/424.1 |
| 6,192,602 | B1 * | 2/2001 | Vuorinen | 34/425 |

FOREIGN PATENT DOCUMENTS

| | | |
|---|---|---|
| DE | 31 28 430 C2 | 1/1983 |
| DE | 43 11 397 A 1 | 9/1993 |
| DE | 43 17 400 C 2 | 12/1994 |
| DE | 197 10 124 A 1 | 9/1998 |
| EP | 0 627 311 B1 | 12/1994 |
| GB | 2 102 344 A | 2/1983 |

* cited by examiner

*Primary Examiner*—Kenneth Rinehart
(74) *Attorney, Agent, or Firm*—Laurence A. Greenberg; Werner H. Stemer; Ralph E. Locher

(57) ABSTRACT

A method of cooling a material web includes, after drying a material web, moving the material web in a given direction on a meander-shaped web path over a cooling cylinder and at least one other cylinder disposed at a location selected from a group thereof consisting of a location upline and a location downline from the cooling cylinder, as viewed in the given direction of the web path, providing for the moving of the material web to be with at least partial looping thereof over the cooling cylinder and the other cylinder, and arranging the cylinders with respect to one another so as to exclude contact pressure with one another that is in effect between two respective ones of the cylinders; a device for performing the method.

32 Claims, 3 Drawing Sheets

METHOD AND DEVICE FOR COOLING A MATERIAL WEB

BACKGROUND OF THE INVENTION

FIELD OF THE INVENTION

The invention relates to a method and a device for cooling a material web, more particularly, a printed paper web.

In the state of the art, cooling units have become known, particularly in printing presses wherein they are used to cool down a material web that-has previously been warmed up in a heating device. It has become known, for example, to guide a single or multisided material web, for example, multicolor-printed, in particular, a paper web, through a dryer, for example, a hot-air dryer, wherein the material web is heated up to between 100° C. and 150° C., due to which the solvents contained in the printing ink vaporize and are disposed of via an exhaust system. After leaving the dryer, the material web, however, has quite a high temperature of approximately 100° C., and the printing ink on the surface of the material web has a certain stickiness or tackiness because of the molten resin of the printing ink. The material web then, for further cooling and for reducing the tackiness prior to being introduced into a folder, is then guided to a cooling-cylinder stand having several cooling cylinders through which coolants flow. The material web is, in this regard, guided around cooling cylinders and surrenders its warmth to the jacket of the cooled-off cooling cylinders. Because, in web-offset printing with heat-set drying, the moisture of the paper is sharply reduced due to the influence of the high temperatures in the dryer, this drying results in a reinforcement of so-called pull or tug waves typical for rotary web offset printing, which then become fixed at the cooling of the material web in the cooling-cylinder stand due to the curing of the printing ink. These tug waves, which are formed diagonally to the web travel direction of the material web, considerably reduce the quality of the printing products.

From the published German Patent Document DE 31 28 430 C2, a rotary printing machine with a cooling unit connected to a dryer has become known, which is supposed to reduce the waviness of the printing products. For this purpose, the cooling unit has cooling cylinders which are engageable with one another in order to subject the print carrier or stock-web running therebetween to a press-calendering process. For that purpose, the cooling cylinders are equipped with an adjustment device which produces the necessary compressive force to be able to effect the engagement of the cooling cylinders with one another, so that the waviness of the printing products is so-called "ironed-out". With the described construction, a problem arises in that the device mentioned therein requires considerable space because of the adjustment unit, and has to have a massive structure because of the prevailing compressive force.

From the published German Patent Document DE 197 10 124 A1, a device for tempering cooling cylinders has become known heretofore, whereby the cooling cylinders are arranged offset from one another, and the material web is guided around the cooling cylinders so that the material web is partially looped around the cooling cylinders, respectively, and is moved between the cooling cylinders on rectilinearly extending free travel paths.

In the published European Patent Document EP 0 627 311 B1, a web-cooling device is described which includes cooling cylinders and dampening devices, and which is arranged next to a dryer, so that the material web coming out of the dryer runs through a slit into the inside of the web-cooling device. The material web is then conveyed between the cooling cylinders in the web-cooling device on a long, straight and free path.

SUMMARY OF THE INVENTION

It is accordingly an underlying object of the invention to provide a method and a device for cooling a material web, by which the formation of pull or tug-waves in the material web are either prevented or at least reduced. Furthermore, it is another object of the invention to provide a method for enabling cooling of the material web and preventing or reducing the formation of pull or tug-waves in the material web in a simple and cost-effective manner.

It is a further object of the invention to provide a device for cooling a material web, which enables the pressman to prevent or at least reduce pull or tug-waves in a material web in a simple and cost-effective manner.

With the foregoing and other objects in view, there is provided, in accordance with a first aspect of the invention, a method of cooling a material web, which comprises, after drying a material web, moving the material web in a given direction on a meander-shaped web path over a cooling cylinder and at least one other cylinder disposed at a location selected from a group thereof consisting of a location upline and a location downline from the cooling cylinder, as viewed in the given direction of the web path, providing for the moving of the material web to be with at least partial looping thereof over the cooling cylinder and the other cylinder, and arranging the cylinders with respect to one another so as to exclude contact pressure with one another that is in effect between respective two of the cylinders.

In accordance with another mode, the method includes moving the material web on an at least approximately always curved web path.

In accordance with a further mode, the method includes moving the material web at least approximately directly from the cooling cylinder to the other cylinder roller.

In accordance with a second aspect of the invention, there is provided a device for cooling a material web with a cooling cylinder around which a material web movable on a web path is partly looped, the cooling device comprising another cylinder disposed at a location selected from a group thereof, respectively, downline from and upline from the cooling cylinder, the material web being partly looped around the other cylinder, the other cylinder being arranged so that the material web is movable from the cooling cylinder to the other cylinder so that the web path runs at least approximately in a meander-shape.

In accordance with another feature of the invention, the other cylinder is a cooling cylinder.

In accordance with a further feature of the invention, the other cylinder is an idler roller.

In accordance with an added feature of the invention, the cooling cylinder has a diameter smaller than 300 mm.

In accordance with an additional feature of the invention, the cooling cylinder has a diameter between 100 mm and 250 mm.

In accordance with yet another feature of the invention, the cooling cylinder has a jacket defining an inner cavity traversible by a coolant.

In accordance with yet a further feature of the invention, the downline location of the other cylinder is directly behind the cooling cylinder, and the upline location of the other cylinder is directly forward of the cooling cylinder in the web path.

In accordance with yet an added feature of the invention, the cooling cylinder is a free-wheeling cylinder.

In accordance with yet an additional feature of the invention, the cooling cylinder is a driven cylinder.

In accordance with still another feature of the invention, the cooling cylinder is an individually driven cylinder.

In accordance with still a further feature of the invention, the driven cooling cylinder is formed as a pull roller for exerting a pulling force on the material web.

In accordance with still an added feature of the invention, the cooling device includes a plurality of cooling cylinders disposed in downline succession along the web path, the material web being looped around the cooling cylinders, respectively, so that the web path along the cooling cylinders extends at least approximately in a meander-shape.

In accordance with still an additional feature of the invention the cooling cylinders, respectively, are arranged in succession, and the web path alongside the cooling cylinders is at least approximately composed of looping sections.

In accordance with another feature of the invention, the cooling cylinders are arranged so as to follow one another directly.

In accordance with a third aspect of the invention, there is provided a cooling-cylinder stand, comprising a device for cooling a material web with a cooling cylinder around which a material web movable on a web path is partly looped, the cooling device including another cylinder disposed at a location selected from a group thereof, respectively, downline from and upline from the cooling cylinder, the material web being partly looped around the other cylinder, the other cylinder being arranged so that the material web is movable from the cooling cylinder to the other cylinder so that the web path runs at least approximately in a meander-shape.

In accordance with a further feature of the invention, the cooling cylinder is a first cooling cylinder, and a first conditioning unit is included which is disposed on a first web side and in a web travel direction upline from the first cooling cylinder.

In accordance with an added feature of the invention, the cooling-cylinder stand includes a second cooling cylinder and a second conditioning unit disposed on a second web side and in the web travel direction upline from the second cooling cylinder.

In accordance with an additional feature of the invention, at least one of the first and the second conditioning units includes a silicone applicator-roller, the first conditioning unit being disposed in the web travel direction upline from an infeed roller, and the second conditioning unit being disposed in the web travel-direction upline from a cooling cylinder located downline from the infeed roller, the first and the second conditioning units, respectively, being disposed on different web sides.

In accordance with a fourth aspect of the invention, there is provided a combination of the cooling-cylinder stand with a dryer, wherein the cooling-cylinder stand is located downline from the dryer for receiving fresh air in the dryer from the cooling-cylinder stand during operation of the dryer.

In accordance with another feature of the invention, the cooling-cylinder stand is located at least approximately directly downline from the dryer.

In accordance with a further feature of the invention, the cooling-cylinder stand is located a distance less than 10 cm from the dryer.

In accordance with an added feature of the invention, the cooling-cylinder stand and the dryer together form one unit.

In accordance with an additional feature of the invention, the combination of the cooling-cylinder stand and the dryer includes a web-tension measuring unit.

In accordance with yet another feature of the invention, the web-tension metering unit includes sensors for at least one of determining the web-tension and detecting a web tear, the sensors serving for monitoring a movement of the cooling cylinder.

In accordance with yet a further feature of the invention, the cooling-cylinder stand includes a register measuring unit having a CCD-camera, and serving for monitoring ink register.

In accordance with yet an added feature of the invention, the cooling-cylinder stand includes a side-margin control unit having a movable cooling cylinder for laterally correcting the position of the material web.

In accordance with a fifth aspect of the invention, there is provided a web-fed rotary printing press, including a device for cooling a material web with a cooling cylinder around which a material web movable on a web path is partly looped, the cooling device comprising another cylinder disposed at a location selected from a group thereof, respectively, downline from and upline from the cooling cylinder, the material web being partly looped around the other cylinder, the other cylinder being arranged so that the material web is movable from the cooling cylinder to the other cylinder so that the web path runs at least approximately in a meander-shape.

The method according to the invention for cooling a material web, particularly a printed paper web, which includes moving the material web on a web path, partial looping of a cooling cylinder with the material web, and cooling the material web by a cooling cylinder, further includes partial entwining of a cooling-cylinder with the material-web distances looping of another cylinder disposed downline or upline therefrom, and the material web is moved away from the cooling cylinder to the other cylinder disposed upline or downline from the cooling cylinder in such a manner that the web-path runs at least approximately in a meander-shape.

Due to the partial looping of the material web around the cooling cylinder and the other cylinder lying either upline or downline from the cooling cylinder, and because of the movement of the material-web away from the cooling cylinder to either the upline or the downline other cylinder, the web path runs at least approximately meander-shaped, prevents pull or tug-waves in the material web according to the invention. The material web is led around the two cylinders on a virtually meander-shaped web-path, so that the web-path is in essence made up of the looping sections of the material web on the two cylinders. In essence, the material web is thereby in steady contact with the surface of a cylinder, so that the curing of the printing ink primarily takes place on the curved web sections along the cylinders, whereby the formation of pull or tug waves in the material web is prevented according to the invention.

Furthermore, the other cylinder, whether lying downline or upline from the cooling cylinder, can be realized in the shape of a roller. Hereinafter, however, refer is made only to a cylinder although it may also be a roller.

Furthermore, the material web can be moved in an advantageous manner, for example, on a substantially always curved path. In this regard, the continuous curving of the web path results from the looping sections of the material web looping around the cylinders, whereby positive and negative curving of the material web alongside a web path can alternate. Rectilinearly extending routes between the cylinders, around which the material web is led, can hereby be prevented in an advantageous manner, whereby at the same time an uncontrolled solidification of the printing ink and a fixing of the pull or tug-waves in the material webs induced thereby can also be prevented.

Furthermore, it is also possible, in an advantageous manner, that the material web be moved substantially directly away from the cooling cylinder towards either the other cylinder lying in front of or behind it. Thereby, the material web can have, for example, a first web section, in which it loops around the cooling cylinder and can have a second web section, which follows the first web section directly and corresponds to a looping-section around the roller lying behind it. The transition region from the first looping section to the second looping section can thereby be such that a first, for example positive, curving passes continuously into a second, for example, negative curving, without having a considerable rectilinearly running web section that lying between the two sections.

The device for cooling a material web according to the invention, particularly a printed paper web, includes a cooling cylinder, which is partially entwined with a material web that is moved on a web path. The device includes a cylinder in front and in back, around which the material web is partially looped, and which are arranged at a distance so that the material web is moved in such a manner from the cooling cylinder to the other cylinder downline or upline therefrom, that the web path runs substantially meander-shaped.

Due to the arrangement of the cooling cylinder according to the invention and the other cylinder lying either upline or downline therefrom, it is made possible to guide the material web on a substantially meander-shaped web path around the cylinders, so that the curing of the printing ink takes place during the contact of the material web with one of the two cylinders and so that an uncontrolled curing of the printing ink and a fixing of the pull or tug-waves in the material webs on clear routes between the cylinders, caused thereby, is prevented or at least reduced.

Provision can thereby be made for the other cylinder lying upline or downline to be either a cooling cylinder or an idler roller. The movement of a material web on a web path along two consecutively arranged cooling cylinders increases the length of the web section on which the web is cooled-off in an advantageous manner and at the same time runs on a curved path, which additionally supports the prevention of tug-waves. If the material-web is led around an idler roller upline or downline from the cooling cylinder, then that idler roller can also be arranged advantageously towards the cooling cylinder, so that the material web is moved on a web path that is substantially meander-shaped.

In a further embodiment of the invention, provision can be made for choosing the diameter of the cooling cylinder smaller than 300 mm, particularly within the range between 100 mm to 250 mm. Through the use of cooling cylinders with small diameters, on the one hand, otherwise required space is reduced in an advantageous manner, and on the other hand, related to the small radius of the cooling cylinders, the contact-force, and the areal pressure, respectively, of the material web applied to the cooling cylinders is increased and the heat transfer of the material web to the cooling cylinder is thereby improved. Due to the compact and offset arrangement according to the invention of the cooling cylinder and other cylinder (or cylinders) that lies downline or upline in connection with the choice of a small diameter of the two cylinders, the required space can additionally be reduced in an advantageous manner. In comparison therewith, prior art cooling cylinders usually measure more than 400 mm in diameter and, therefore, require more space.

For example, it is possible to select a cooling cylinder with a diameter of 150 mm for a material-web width of 1.5 m and a cooling cylinder with a diameter of 180 mm for a material-web width of 2.0 m.

Furthermore, it is possible, in an advantageous manner, that the cooling cylinder includes a jacket defining an inner cavity limited by the jacket, whereby the cavity is traversed by a coolant, in particular cooled water. As the cooling cylinder preferably does not have a structured layout in the interior thereof, but only a cavity, the weight of the cooling cylinder is then reduced in an advantageous manner, also. As learned by the applicant, the combination of a cooling cylinder without a specific inner construction, such as, for example, special inserts for circulating the coolant, in connection with the choice of a small diameter results in particularly light and reliably cooling cylinders and, thereby, to support for preventing tug-waves.

In a further construction of the invention, the other cylinder upline and downline from the cooling cylinder in the travel direction of the webs can lie substantially directly upline or downline therefrom. The other cylinder lying downline or upline can thus in an advantageous manner be arranged towards the cooling cylinder, so that the paper transfer results without an intermediate region directly from the cylinder lying upline from the cooling cylinder and/or from the cooling cylinder to the cylinder roller lying downline, whereby, however, the cylinders do not have to be employed together. Because of this particular manner of arrangement, the required space for the two rollers can additionally be reduced in an advantageous manner.

Furthermore, provision can be made for the cooling cylinder to be a free-running or free-wheeling cylinder. The cooling cylinder can thereby be rotated in an advantageous manner only by using the frictional forces prevailing between the material web and the cooling cylinder, so that driving devices of any kind can be avoided and energy and costs can thereby be saved.

It is, however, also conceivable that the cooling cylinder be a driven cylinder, in particular an individually powered cylinder. In this way, the powered cooling cylinder can, for example, be used as a pull or tug-cylinder, by which a tug tension in the material web is maintained, created or modified. The cooling cylinder that is used as a tug-cylinder can thereby, for example, also effect the conveyance of the material web through the dryer, for example, through a hot-air dryer.

With the use of a tug or pull cylinder, the tug tension can be controlled in an advantageous manner so that the formation of tug-waves, in particular because of a tug tension that is too high, is prevented.

In a further embodiment of the invention, it is also possible for the device to include a multiplicity of cooling cylinders lying in succession behind one another, with the material web partially looped about each of the cooling cylinders, the cooling cylinders being arranged in a way that the web path alongside the cooling cylinders runs substantially meander-shaped.

Thus, provision can be made, for example, for leading the material web around a larger number of cooling cylinders, following one another, for example, three to seven successive cooling cylinders, so that the material web is completely cooled-off, before it leaves the last of the subsequently arranged cooling cylinders, and the printing ink is cured enough to prevent a formation of tug-waves on the web path lying upline from the cooling cylinders. For example, the material web can then be moved along a web path that extends rectilinearly behind the last cooling-cylinder, without having to deal with a formation of tug-waves in the material web.

Furthermore, provision can be made for arranging the cooling cylinders to follow one another so that the web path along the cooling cylinders is composed substantially of the looping sections, or so that the cooling cylinders are arranged directly following one another.

A further embodiment of the invention includes a Cooling-cylinder stand, with the aforedescribed device for cooling a material web, in particular a printed paper web.

Furthermore, provision can be made for the cooling-cylinder stand to have a first cooling cylinder and a first conditioning unit, wherein preferably the first conditioning unit is arranged on a first web side of the material web and in the web travel direction upline of the first cooling cylinder. The first cooling cylinder can thereby, in the travel direction of the web, be the first cooling cylinder of the cooling-cylinder stand, which is looped about by the material web. Furthermore, the cooling-cylinder stand can have a second cooling cylinder and a second conditioning unit, wherein the second conditioning unit is preferably arranged on a second web side and in the travel direction of the web downline from the second cooling cylinder. Thus, it is, for example, possible that the second cooling cylinder, as viewed in the travel direction of the web, is the second cooling cylinder of the cooling-cylinder stand and thus lies upline from the first cooling cylinder in the travel direction of the web. Provision can also be made for the first and the second conditioning unit to have silicone applicator-rollers for applying a silicone-oil emulsion onto the material web, the first conditioning unit being arranged in the travel direction of the web upline of the infeed roller of the cooling-cylinder stand, and the second conditioning unit is arranged in the travel direction of the web downline from the cooling cylinder lying upline from the infeed roller.

Moreover, the possibility also exists, however, for arranging the first and the second conditioning unit, respectively, on the same side of the material web, if so desired. Due to the arrangement of conditioning units in the cooling-cylinder stand, in an advantageous manner, a condensation of mineral-oil vapors from the air boundary-layer adhering to the material web can be prevented, whereby the problem of ink build-up on the cooling cylinders is additionally avoided. Assurance is thereby provided, in an advantageous manner, that the surfaces of the cooling cylinders remain clean and even, so that heat transfer can be effected from the material web to the cooling cylinder without interference, and the material web is cooled-off sufficiently while looping around the cooling cylinders, before it is moved along the web path on a clear, rectilinear route. The formation of tug-waves and their fixation in the material web is hereby additionally prevented in an advantageous manner.

According to a preferred embodiment of the invention the cooling-cylinder stand lies upline from a dryer, in particular so that fresh air is drawn or blown into the dryer through the cooling-cylinder stand. With the arrangement of the cooling-cylinder stand preferably substantially directly downline from the dryer and at a distance from the dryer, which is smaller than ,for example, 10 cm, the fresh air required in the dryer is also at the same time used to make the cooling-cylinder stand the right temperature and to transport solvent vapors which discharged from the material web because of post-vaporization. With the advantageous tempering of the cooling-cylinder stand additionally, the prevention of tug-waves is positively influenced, whereby an advantage is provided for the pressman, at the same time, that the solvent vapors do not escape from the cooling-cylinder stand in an uncontrolled manner and do not place a strain upon the breathing air in the printing room. Instead, the fresh-air is either sucked-in or also blown into the dryer together with the solvent-vapors in an advantageous manner, and is preferably fed to the combustion-process there, indirectly or directly.

Furthermore, provision can be made for the cooling-cylinder stand to form a unit, together with the dryer, for example, a structural unit or also a unit that is created by a common housing. The supply of fresh air for the dryer straight through the cooling-cylinder stand is thereby assured in an advantageous manner, which supports at the same time the tempering of the cooling-cylinder stand and, connected therewith, the prevention of the formation of tug-waves and, as another advantage, the reduction of the adjustment space for the dryer and the cooling-cylinder stand.

In a further advantageous embodiment of the invention, provision may be made for the cooling-cylinder stand to have a web-tension measuring unit, whereby the web-tension measuring unit may, for determining the web-tension or for detecting a web tear, include a cooling cylinder and sensors or sensor agents. The use, for example, of a deflectable cooling cylinder in the web-tension measuring unit, whereby the deflection of the cooling cylinder with varying web tension, can be detected by a sensor, for example, a piezo-element, results first, in an advantageous manner, in a saving of additional building materials in the web-tension measuring unit. It also, however, results in the advantage that the web-tension measuring device, which is integrated into the cooling-cylinder stand, maintains a desired web tension within the cooling-cylinder stand by a control and/or regulation device that is connected therewith, whereby the contact force of the material web onto the cooling cylinders has a desired size within the looping sections of the web path, so that the heat transfer from the material web to the cooling cylinder lies in a region advantageous for the printing process. Assurance is thereby provided that the material web has been cooled-off sufficiently after leaving the last cooling cylinder of the cooling-cylinder group, and that the printing ink on the material web is cured sufficiently, so that there is no fixation of uncontrolled created tug-waves on the following, for example, rectilinear, freewheeling web paths.

Furthermore, the cooling-cylinder stand may include a register-measuring unit, which can, in particular, contain a CCD-camera, which is used for the surveillance or monitoring of the ink or color register.

With the integration of a register-measuring unit into the cooling-cylinder stand, on the one hand, another space-saving is possible and, on the other hand, a very reliably working ink-register control results from the combination of the register-measuring unit with the construction, according to the invention, of the cooling-cylinder stand, which ensures that tug-waves within the material-web are prevented. This can be traced back to the fact that because of the prevention of tug-waves in the material web, by the camera, the even surface of the material web, which is not disturbed by waves, can be recorded correctly, and the ink register can be set by a control and/or regulation device.

Furthermore, the cooling-cylinder stand may include a side-margin control unit which, for the purpose of controlling the side-margin, includes a movable, in particular swivel-mounted, cooling cylinder. Assurance is thereby advantageously provided, that the material-web be lead over the cooling cylinders within the cooling-cylinder stand in the desired position, for example, centered around the central axis of the cooling-cylinder stand, whereby the cooling effect of the cooling cylinders is assured, which has as a consequence a positive influence upon the prevention of the formation of tug-waves in the material web. At the same time, lateral modifications of the web position, which can, for example, result from the free guidance of the material web in the dryer that lies upline from the cooling-cylinder stand, can be corrected in an advantageous manner, so that the material web is positioned in the desired position through the cooling-cylinder stand, and is also guided to the following folder by the cooling-cylinder stand.

Other features which are considered as characteristic for the invention are set forth in the appended claims.

Although the invention is illustrated and described herein as embodied in a method and a device for cooling a material web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
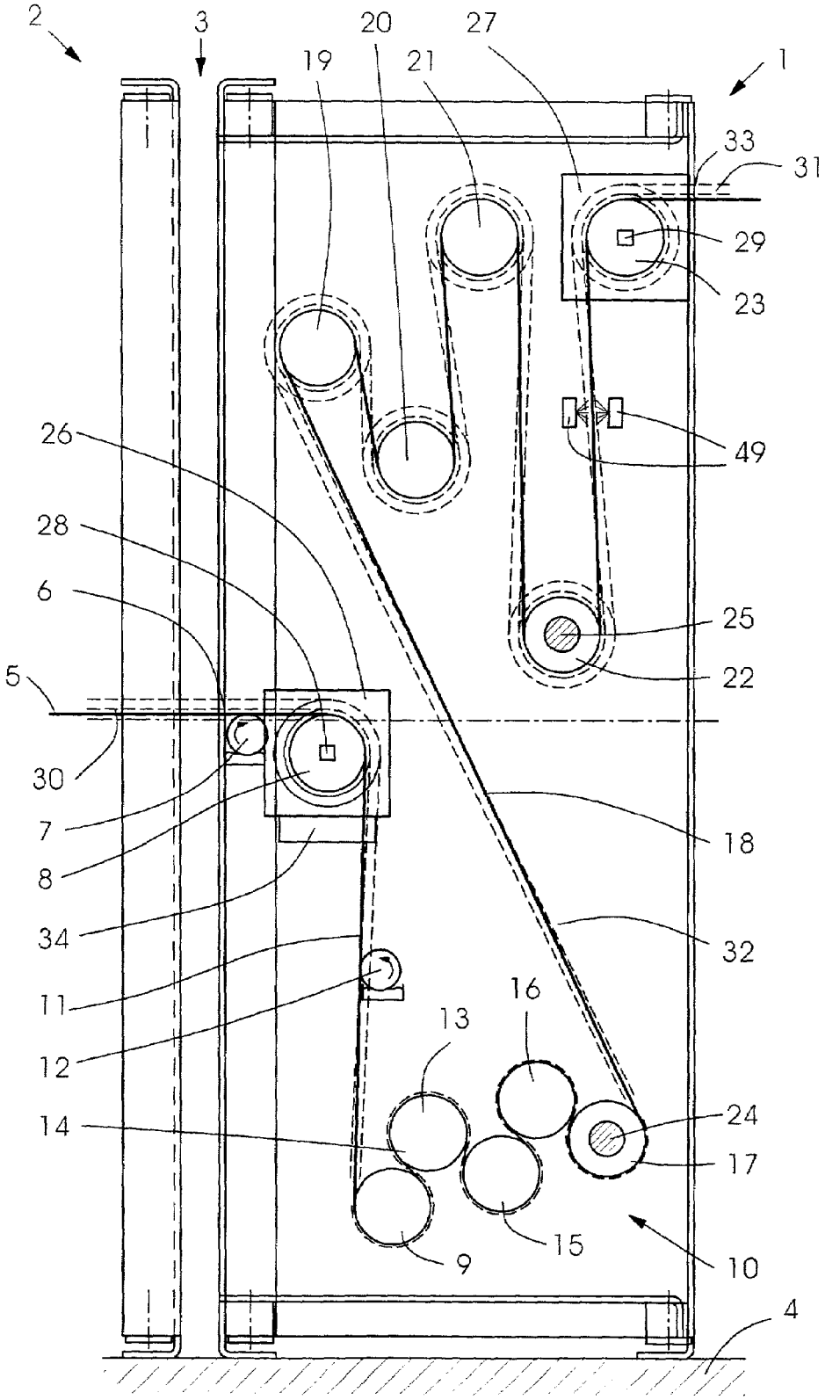
FIG. 1 is a diagrammatic sectional view of a cooling-cylinder stand according to the invention having a device according to the invention for cooling-off a material web.

Referring now to the drawings and, first, particularly to FIG. 1 thereof, there is shown therein a cooling-cylinder stand 1, which is arranged at a distance 3 from a diagrammatically represented dryer 2 and is firmly anchored on the floor 4 of a printing room. A material web 5 leaves the dryer 2 and runs into the cooling-cylinder stand 1 at an infeed location 6. Initially, the material web 5 is contacted on a first web-side by a silicone applicator-roller 7, and thereby coated thereon with a silicone-oil emulsion. Thereafter, the material web 5 runs, with the silicone-oil coated side thereof, over a first cooling cylinder 8, which serves simultaneously as an idler or deflecting roller and is guided thereby to a second cooling cylinder 9 of a cooling-cylinder group 10. On a rectilinearly extending free web path 11, the material web 5 is brought into contact with a silicone applicator-roller 12 at a second side of the material web, and a silicone-oil emulsion is thus applied also to the second side of the web. On the farther web-path, the material web 5 loops around the second cooling cylinder 9, in contact therewith by the second silicone-oil coated side of the material web, and follows multiple looping sections of different cooling cylinders 9, 13, 15, 16 and 17 along the web path. The material web 5 leaves the looping section of the second cooling cylinder 9 and runs virtually directly into the looping section of the third cooling-cylinder 13, so that the material web has an at least approximate meander-shaped web course along the web path. In this regard, the length of the intermediate section 14 of the material web between the second cooling cylinder 9 and the third cooling cylinder 13 is thereby reduced, as far as structurally possible, and is decreased to a minimum. The web guidance in accordance with the invention is believed to be readily apparent from FIG. 3.

The material web 5 is guided around the cooling cylinders 15, 16 and 17 in further looping sections, the meander-shaped web course of the material web 5 being maintained. The material web that is coated on both sides with silicone-oil and that is sufficiently cooled-off by the five cooling cylinders 9, 13, 15, 16 and 17 is then guided to a further cooling cylinder 19 via a web section with a rectilinear web course 18, the cooling cylinder 19 being preferably arranged above the first cooling cylinder 8. After the material web 5 has left the looping section of the cooling cylinder 17, the temperature has been cooled-off to such an extent that the printing ink is cured sufficiently on the surface of the material web and, as a consequence, does not possess any unwanted stickiness anymore, so that no pull or tug-waves running along the material web 5 are formed anymore on the rectilinear web section 18 and become fixed by drying of the printing ink. In the manner according to the invention, the cooling cylinders of the cooling-cylinder group 10 are packed so tightly and offset from one another, that the web course of the material web 5 virtually always has a curve along the looping sections of the individual cooling cylinders, and the material web 5 is always in contact with the surface of one of the cooling cylinders of the cooling-cylinder group 10, except at transition-points between the cooling cylinders, which are reduced to a minimum lengthwise. Due to this special type of web guidance, in the manner according to the invention, a steady heat-transfer from the material web 5 to the cooling cylinders of the cooling-cylinder group 10 is assured, and the material web 5 leaves the succeeding looping sections of the cooling cylinders of the cooling-cylinder group 10, only when the material web 5 is cooled-off sufficiently.

The material-web 5 is furthermore guided around the cooling cylinders 19, 20, 21, 22 and 23, which can indeed be arranged with respect to one another in the same manner as through the cooling cylinders 9 to 17 with at least approximately tangential contact points, which, however, do not forcibly have to be packed so tightly and offset from one another, like the cooling cylinders of the cooling-cylinder group 10, because a sufficiently high cooling of the material web 5 has already taken place.

The cooling cylinders 17 and 22, respectively, are equipped with a motor 24, 25 as a driving-unit, it being also sufficient if only one of the two cooling cylinders 17 and 22 is equipped with a motor, and this motor 24 or 25 is used for maintenance of the necessary web tension of the material web 5. For monitoring the tension of the material web 5, the cooling cylinders 8 and 23, respectively, are equipped with the respective web-tension measuring units 26 and 27, which also include, near the deflectable or movable cooling cylinders 8 and 23, preferably also sensors 28 and 29, with which the modification of the deflection or the movement of the respective cooling cylinder 8, 23, effected by varying web tension, is determined. The sensors 28 and 29, as shown in FIG. 1, can be mounted, for example, at axle bearings of the respective cooling cylinders 8 and 23, and can determine the bearing-forces occurring there, by dynamometers, for example, with piezo-elements. In this regard, the cooling cylinders 8 and 23 can, for example, be loaded with spring force, so that the cooling cylinders 8 and 23 are deflected from the idle position thereof, when the web tension changes. The web-tension values, which are determined from at least one of the two web-tension measuring units 26 or 27, are guided to a non-illustrated control and/or regulation device, which controls the motors 24 and 25 and which thereby corrects the web tension in the desired manner. The web-tension measuring unit 26 is used primarily for determining the web tension in the web section 30, and the web-tension measuring unit 27 is used primarily for determining the web tension in the web section 31. By the illustrated web-tension measuring units 26 and 27, a web tear can also be detected, which may be caused, for example, by a sudden supernormal web-tension change, whereby then the non-illustrated control device preferably can trigger an emergency-stop of the printing press or can activate a web-catching device.

While the measuring of the web tension can basically be performed at any cooling cylinder with a respective Web-tension measuring unit, it is preferably done at the cylinders 8, 9, 13, 15, 16 and 17, and especially at the cylinder 9. The measuring can be accomplished by force measuring in or at the cylinder bearings or even by utilizing an appropriate lever device, which allows for a deflection of the cylinder and cooperates with a sensor.

The cooling-cylinder stand shown in FIG. 1, furthermore, has a web infeed device 32, with which the start of the material web 5 is guided around the individual cooling cylinders, after it has come from the dryer 2 through the cooling-cylinder stand 1 at the setting-up of the printing-press, until finally the web starting end of the material web 5 runs out of the cooling-cylinder stand at the outlet location 33. Furthermore, in FIG. 1*a*, a deflection or swivel-mechanism 34 is shown, which serves to swivel or deflect the first cooling-cylinder 8 for aligning the side-margins in the cooling-cylinder stand around a swivel axis extending perpendicularly to the rotational axis of the first cooling cylinder 8.

Furthermore, the cooling-cylinder stand can also have a re-moistening unit 49 for again providing moisture content to the dried and cooled-off web 5 before the infeed into the folder, which is necessary for a smooth or frictionless and qualitatively high-grade further processing of the printed web 5. For this purpose, for example, a moistening agent can be applied to the web 5 by electrostatically charging the moistening agent and the web 5.

Figure 2:
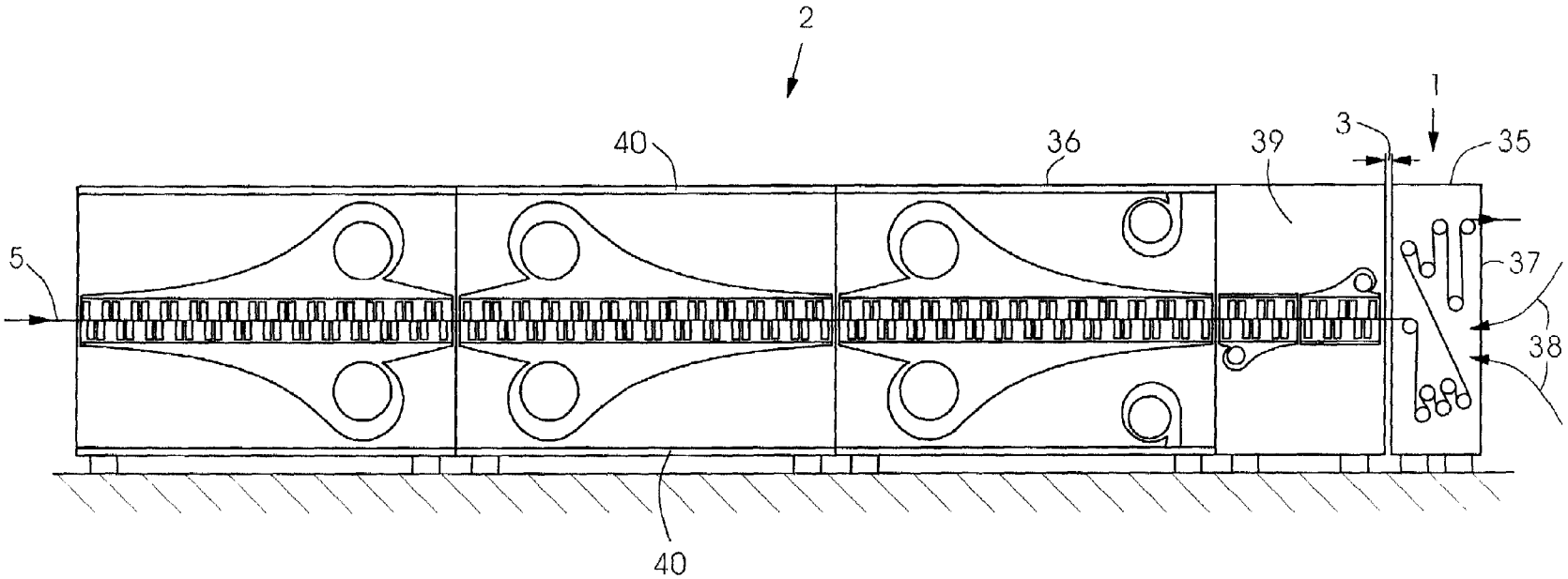
FIG. 2 is a reduced diagrammatic view of the cooling-cylinder stand of FIG. 1 and a dryer which, together, form a unit.

FIG. 2 shows a hot-air dryer 2 with, downline therefrom, as viewed in a web travel direction, a cooling-cylinder stand 1 according to the invention for drying a paper web 5, which has been printed on both sides thereof by a non-illustrated web-fed rotary offset printing press. The cooling-cylinder stand 1 has a housing 35, which is disposed a distance 3 from the housing 36 of the dryer 2. The mutually spaced-apart distance 3 prevents the cooling-cylinder stand 1 from moving together with the dryer 2 if a movement and/or deformation of the dryer 2 should occur, and the web tension between the cooling-cylinder stand 1 and a following processing-unit, for example, a folder, from being unfavorably influenced thereby. A movement and/or deformation of the dryer 2 can, for example, result from the different distribution of the heat-producers within the dryer. The housing 35 of the cooling-cylinder stand 1 is open at the housing-side 37, preferably exclusively in the region of the outlet opening of the material web 5, so that fresh air 38 can flow through the open housing-side 37 into the cooling-cylinder stand 1 and from there through one or more non-illustrated openings of a cooling-zone 39 of the dryer 2. In this regard, the fresh-air 38 tempers the cooling-cylinder stand to the correct temperature and prevents the escape of solvents from the cooling-cylinder stand 1 into the surrounding air of the printing room, the solvents escaping by after-vaporization from the material web 5 into the cooling-cylinder stand 1. The fresh-air that is enriched with the solvents is used for drying the material web 5 in the dryer 2, the solvents, for example, being energetically re-used in an after-burning zone 40.

The advantageous combination of the arrangement of the cooling-cylinders according to the invention and of the web path according to the invention, with the cooling cylinders having small diameters, the fresh-air supply through the cooling-cylinder stand, the two silicone applicator-rollers, the control of the side-margin and the control of the web tension result in a particularly advantageous prevention or at least reduction of the pull or tug-waves in the material web.

Figure 3:
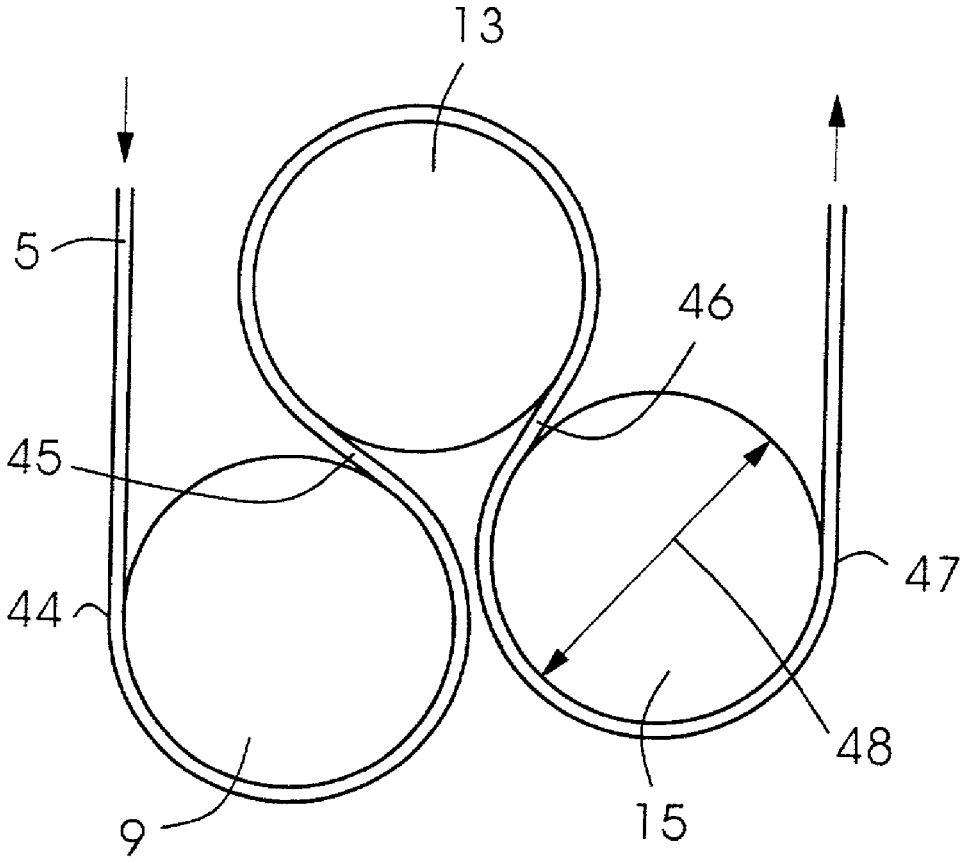
FIG. 3 is an enlarged fragmentary side elevational view of FIG. 1 showing three of the cooling cylinders arranged according to the invention.

FIG. 3 shows in a detailed side elevational view diagrammatically the course of the material web 5 along-side the three cooling cylinders 9, 13 and 15. The material web 5 contacts the cooling cylinder 9 at a location 44 and loops around the cooling cylinder 9 preferably up to a first transition location 45 at which the material web 5 merges with and deflects from, respectively, the cooling-cylinder 9 to the cooling-cylinder 13. Thereafter, the material web 5 loops around the cooling cylinder 13 up to a second transition location 46, at which the material web 5 merges with the cooling cylinder 15. The material web 5 leaves the looping region with the cooling-cylinder 15 at the last contact location 47, and runs, for example, on a rectilinear, free web section to a non-illustrated following roller. As is apparent from FIG. 3, the looping sections of the material web 5 with the individual cooling cylinders 9, 13 and 15 are connected so that the material-web 5 is moved at least approximately on a meander-shaped web path from the first contact position 44 to the last contact position 47. Due to the tight packing of the cooling cylinders 9, 13 and 15 and the offset arrangement, the first and the second transition positions 45 and 46 have virtually no rectilinear and freely running web sections. This particular manner of arranging the cooling cylinders in connection with the large looping sections and the small diameter 48 of the cooling cylinders has, as a consequence, a particularly advantageous cooling with a simultaneous prevention of pull or tug-waves in the material web 5 that would reduce the quality thereof. The material web 5, according to the invention, does not have or has only a very, very short rectilinear free or clear web guidance at the transition locations 45 and 46, which is, for example, smaller than 5 cm.

Other than as shown in FIG. 3, it is possible to place the shaft or axle of the cooling cylinder 15 at least approximately in a common plane with the respective shafts or axles of the cooling cylinders 9 and 13 and to have the material web 5 follow in a snake-like web path along the cooling cylinders 9,13, and 15.

Furthermore the rollers 9, 13 and 15 can simultaneously be in contact with the web at the tangential points in a further preferred embodiment.

In a non-illustrated manner, the rollers 9, 13 and 15 can also be arranged so that they are adjustable with respect to one another, and so that the mutual spacing of two rollers can be adjusted in accordance with the different paper thicknesses.

I claim:

1. A method of cooling a material web, which comprises:

moving the material web in a given direction over a cooling cylinder and at least one other cylinder disposed at a location selected from the group consisting of a location upline and a location downline from the cooling cylinder, as viewed in the given direction of the web path;

carrying out the step of moving of the material web with looping sections of the material web passing over the cylinders, the looping sections being connected for moving the material web along the looping sections at least approximately on a web path being meander-shaped, always curved or non-rectilinear; and arranging the cylinders with respect to one another so as to exclude contact pressure with one another between respective two of the cylinders.

2. The method according to claim 1, which includes moving the material web at least approximately directly from the cooling cylinder to the other cylinder roller.

3. The method according to claim 1, which includes carrying out the step of moving the material web on a web path being meander-shaped, always curved or non-rectilinear by having substantially no straight line section in the web path.

4. A device for cooling a material web comprising:

a cooling cylinder around which the material web movable on a web path is partly looped; and another cylinder disposed at a location selected from the group consisting of downline from and upline from the cooling cylinder;

the material web having looping sections passing over said cylinders, the looping sections being connected for moving the material web along the looping sections at least approximately on a web path being meander-shaped, always curved or non-rectilinear.

5. The device according to claim 4, wherein said other cylinder is a cooling cylinder.

6. The device according to claim 4, wherein said other cylinder is an idler roller.

7. The device according to claim 4, wherein the cooling cylinder has a diameter smaller than 300 mm.

8. The device according to claim 4, wherein the cooling cylinder has a diameter between 100 mm and 250 mm.

9. A device according to claim 4, wherein said cooling cylinder has a jacket defining an inner cavity traversible by a coolant.

10. The device according to claim 4, wherein said downline location of said other cylinder is directly behind the cooling cylinder, and said upline location of said other cylinder is directly forward of the cooling cylinder in said web path.

11. The device according to the claim 4, wherein said cooling cylinder is a free-wheeling cylinder.

12. The device according to claim 4, wherein the cooling cylinder is a driven cylinder.

13. The device according to claim 4, wherein the cooling cylinder is an individually driven cylinder.

14. The device according to claim 12, wherein said driven cooling cylinder is formed as a pull roller for exerting a pulling force on the material web.

15. The device according to claim 4, wherein said other cylinder includes a plurality of cooling cylinders disposed in downline succession along said web path.

16. The device according to claim 15, wherein said cooling cylinders, respectively, are arranged in succession, and said web path alongside said cooling cylinders is at least approximately composed of said looping sections.

17. The device according to claim 15, wherein said cooling cylinders are arranged so as to follow one another directly.

18. The device according to claim 4, wherein said other cylinder is arranged so that the web path has substantially no straight line section.

19. A cooling-cylinder stand, comprising:

a device for cooling a material web including:

a cooling cylinder around which the material web movable on a web path is partly looped; and another cylinder disposed at a location selected from the group consisting of downline from and upline from the cooling cylinder;

the material web having looping sections passing over said cylinders, the looping sections being connected for moving the material web along the looping sections at least approximately on a web path being meander-shaped, always curved or non-rectilinear.

20. The cooling-cylinder stand according to claim 19, wherein the cooling cylinder is a first cooling cylinder, and including a first conditioning unit disposed on a first web side and in a web travel direction upline from said first cooling cylinder.

21. The cooling-cylinder stand according to claim 20, including a second cooling cylinder and a second conditioning unit disposed on a second web side and in the web travel direction upline from said second cooling cylinder.

22. The cooling-cylinder stand according to claim 21, wherein at least one of said first and said second conditioning units includes a silicone applicator-roller, said first conditioning unit being disposed in said web travel direction upline from an infeed roller, and said second conditioning unit being disposed in said web travel-direction upline from a cooling cylinder located downline from said infeed roller, said first and said second conditioning units, respectively, being disposed on different web sides.

23. A combination of the cooling-cylinder stand according to claim 19 with a dryer, wherein the cooling-cylinder stand is located downline from the dryer for receiving fresh air in the dryer from the cooling-cylinder stand during operation of the dryer.

24. The combination according to claim 23, wherein the cooling-cylinder stand is located at least approximately directly downline from the dryer.

25. The combination according to claim 24, wherein the cooling-cylinder stand is located a distance less than 10 cm from the dryer.

26. The combination according to claim 23, wherein the cooling-cylinder stand and the dryer together form one unit.

27. The combination according to claim 23, including a web-tension measuring unit.

28. The combination according to claim 27, wherein said web-tension metering unit includes sensors for at least one of determining the web-tension and for detecting a web tear, said sensors serving for monitoring a movement of the cooling cylinder.

29. A cooling-cylinder stand according to claim 19, including a register measuring unit having a CCD-camera, and serving for monitoring ink register.

30. A cooling-cylinder stand according to claim 19, including a side-margin control unit having a movable cooling cylinder for laterally correcting the position of the material web.

31. The device according to claim 19, wherein said other cylinder is arranged so that the web path has substantially no straight line section.

32. A web-fed rotary printing press, including a device for cooling a material web, the cooling device comprising:

a cooling cylinder around which the material web movable on a web path is partly looped; and another cylinder disposed at a location selected from the group consisting of downline from and upline from the cooling cylinder;

the material web having looping sections passing over said cylinders, the looping sections being connected for moving the material web along the looping sections at least approximately on a web path being meander-shaped, always curved or non-rectilinear.

* * * * *